US005819958A

United States Patent [19]

Dement

[11] Patent Number: 5,819,958

[45] Date of Patent: Oct. 13, 1998

[54] SHELVING SYSTEM

[75] Inventor: Thomas Russell Dement, Dayton, Ohio

[73] Assignee: The Shelving Company, Inc., Dayton, Ohio

[21] Appl. No.: 840,401

[22] Filed: Apr. 29, 1997

[51] Int. Cl.[6] ..... A47F 5/00

[52] U.S. Cl. ..... 211/90.01; 211/90.04; 211/94.01; 312/245; 108/152

[58] Field of Search ..... 211/94.01, 90.01, 211/90.04, 187, 103, 87.01; 312/245; 108/152

[56] References Cited

U.S. PATENT DOCUMENTS

| | | | |
|---|---|---|---|
| 4,807,764 | 2/1989 | Bellin | 211/94.01 |
| 4,928,833 | 5/1990 | Huizenga . | |
| 5,110,080 | 5/1992 | Rieman | 211/94.01 X |
| 5,191,986 | 3/1993 | Huizenga . | |
| 5,495,954 | 3/1996 | Schmit | 211/90.04 |
| 5,622,272 | 4/1997 | Orlando | 211/90.01 |

*Primary Examiner*—Robert W. Gibson, Jr.
*Attorney, Agent, or Firm*—Killworth, Gottman, Hagan & Schaeff, L.L.P.

[57] ABSTRACT

The present invention is directed to a wall mounted shelving system. The shelving system includes a horizontal support rail mountable on a wall. The support rail has a bottom edge from which a flange extends upwardly and outwardly. The shelving system also includes a plurality of vertical support members slidably mountable on the support rail. Each vertical support member has an end portion which abuts the wall and a cutout portion in the end portion. The cutout portion is shaped to receive the flange of the support rail as the vertical support member is slid horizontally onto the support rail. The cutout portion is also shaped so that the end portion of the vertical support member hangs flush with the wall.

13 Claims, 4 Drawing Sheets

SHELVING SYSTEM

BACKGROUND OF THE INVENTION

The present invention relates to a shelving system which is adjustable to fit storage areas of varying sizes.

It is currently popular to provide storage organizing systems and shelving systems which can be easily disassembled and rearranged. The systems typically include clothes hanging rods and shelves which can be variably positioned to accommodate a variety of items.

For example, U.S. Pat. No. 4,928,833 to Huizenga describes one such system. In the Huizenga system, a horizontal rail is mounted on the wall. The horizontal rail comprises a first leg which is attached to the wall and a second leg which projects outwardly from the wall from the top of the first leg. The two legs are arranged at an angle of 50° to each other. Vertical panels are positioned on the rail by means of a cutout on the edge of the vertical panel which is adjacent to the wall. The panels are hung on the rail by dropping the cutout portion down and over the second leg of the horizontal rail. To provide stability, the vertical panels are preferably positioned adjacent to side walls. This system has several disadvantages.

First, because the cutout portion is designed to be positioned on the rail by dropping the vertical panel down and over the rail, a substantial portion of open space exists between the second leg of the rail and the inner periphery of the cutout portion. This open space allows the vertical panels to be moved off the support rail when the vertical panels are nudged or bumped. Second, the open space prevents the vertical panels from being mounted flush with the wall against which the vertical panel is mounted. Third, the vertical support panels hang from the horizontal rail in such a manner that a torque is applied to the horizontal rail which causes the support rail to bend, especially, at its ends. Finally, because the vertical panels have to be placed on the horizontal rail by dropping the vertical panels down and over the horizontal rail, the tops of the vertical panels can not be positioned flush with a ceiling.

For these reasons, a need exists in the art for an adjustable shelving system which is stable and which has vertical support panels that can be mounted flush against a wall and a ceiling.

SUMMARY OF THE INVENTION

The present invention solves the needs currently existing in the art by providing an adjustable shelving system which is stable and which has vertical support members that can be mounted flush against a wall and a ceiling.

One aspect of the present invention is directed to a wall mounted shelving system. The shelving system includes a horizontal support rail mountable on a wall. The support rail has a bottom edge from which a flange extends upwardly and outwardly. The shelving system also includes a plurality of vertical support members slidably mountable on the support rail. Each vertical support member has an end portion which abuts the wall and a cutout portion in the end portion. The cutout portion is shaped to receive the flange of the support rail as the vertical support member is slid horizontally onto the support rail. Because the vertical support member is slid horizontally onto the support rail, rather than being dropped down over it, the vertical support member may be sized to fit flush with the ceiling. The cutout portion is also shaped so that the end portion of the vertical support member hangs flush with the wall. Desirably, the flange extends about 450 outwardly from the horizontal support rail. Further, it is desirable that the support rail includes a plurality of openings spaced so that at least one of the openings can be positioned in a position corresponding to a stud in the wall.

Typically, the shelving system includes at least one storage member removably mountable between two adjacent vertical support members. The shelving member can be either a shelf, a hanging rod or both.

The shelving system of this invention may also include an L-shaped bracket, which is attached to the wall and a bottom portion of the vertical support member, to prevent the vertical support member from being moved.

In another aspect of this invention, the flange on the support rail may further include a space which separates the support rail into a first flanged portion and a second flanged portion. The space is provided to allow the vertical support members to be slidably positioned on the support rail from a position somewhere other than at the ends of the support rail. Desirably, the space has a width slightly greater than a width of the end portion of the vertical support member.

In still another aspect of the invention, the shelving system can further include a second horizontal support rail mountable on the wall. The second support rail includes a second flange which extends upwardly and outwardly from the wall. In this aspect of the invention, each vertical support member further includes a second cutout portion which is shaped to receive the second flange of the second support rail as the vertical support member is slid horizontally onto the second support rail. The second cutout portion is further shaped so that the edge of the vertical support member hangs flush with the wall.

Another aspect of this invention is directed to a method for installing a shelving system. One step includes mounting a horizontal support rail on a wall. The support rail has a bottom edge from which a flange extends upwardly and outwardly. Another step includes sliding horizontally onto the support rail a plurality of vertical support members. Each vertical support member has an end portion which abuts the wall and a cutout portion in the end portion. The cutout portion is shaped to receive the flange of the support rail as the vertical support member is slid horizontally onto the support rail. Further, the cutout portion is shaped so that the end portion of the vertical support member hangs flush with the wall. Another step includes positioning storage members between the vertical support members. Desirably, the method also includes the step of securing the vertical support members to the wall with a bracket.

In another aspect of the method, the support rail includes a space which separates the flanged portion into a first flanged portion and a second flanged portion. In this aspect of the method, the step of sliding the vertical support member onto to the rail includes the step of sliding the vertical support member horizontally onto either the first flanged portion or the second flanged portion.

Accordingly, it is an object of the present invention to provide an adjustable shelving system which is stable and which has vertical support members that can be mounted flush against a wall and/or a ceiling. It is further an object of this invention to provide a method for assembling such a shelving system. These, and other objects and advantages of the present invention, will become apparent from the following drawings, detailed description and appended claims.

DETAILED DESCRIPTION

Figure 1:
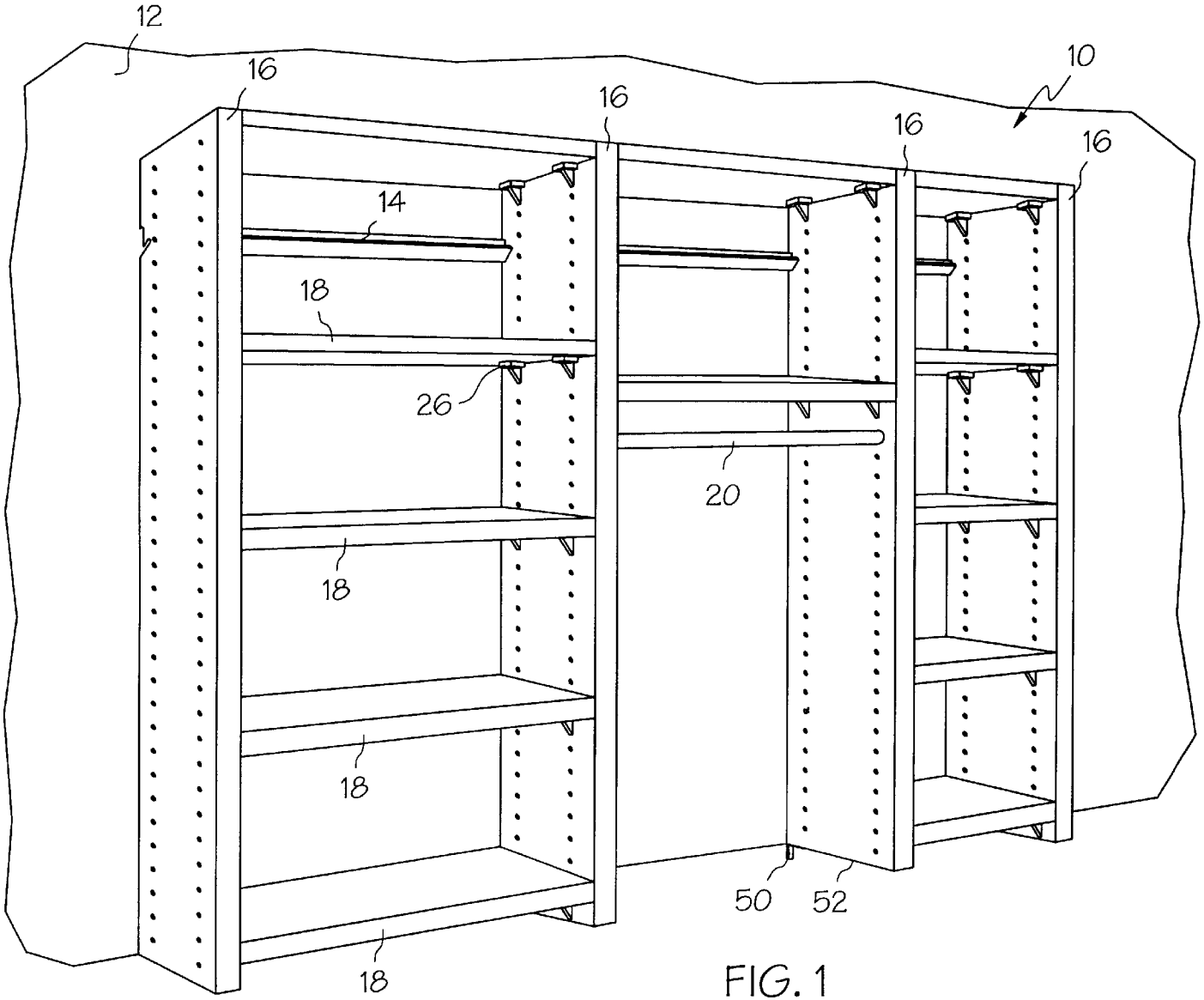
FIG. 1 presents a perspective view of the shelving system of this invention.

The shelving system 10 of this invention is shown in FIG. 1. The system 10 is positioned on a wall 12 and includes a horizontal support rail 14, at least two vertical support members 16 and at least one storage member such as a shelf 18 or a hanging bar 20. More specifically, the horizontal support rail 14 is hung on the wall 12 and the vertical support members 16 are positioned on rail 14. The vertical support members 16 are positioned a distance apart to accommodate positioning of the shelves 18 and the hanging rods 20. The shelves 18 and the hanging rods 20 are then positioned between the two vertical support members 16.

The vertical support members 16, shelves 18 and hanging rods 20 can be made of any material currently used in the art to make such items. For example, the support members 16 and the shelves 18 can be made from wood, pressed board, laminated board, particle board, metal or plastic. Desirably, the support members 16 and the shelves 18 are made from wood or a wood product. The vertical support members 16 can have any length which fits the shelving system. Desirably, the vertical support members 16 will come in lengths of about 30 inches (76.2 cm), 72 inches (183 cm), or about 96 inches (244 cm). Shelves 18 can come in varying lengths and are typically about 18 inches (46 cm) in length or longer. Hanging rods 20 can be made from wood, plastic or metal with wood and metal being desired. If hanging rods 20 are formed of metal or plastic, they can be telescoping, i.e., have two sections, one of which has a diameter smaller than the other so that one section can be slid in respect to the other section to provide variable lengths.

Figure 2:
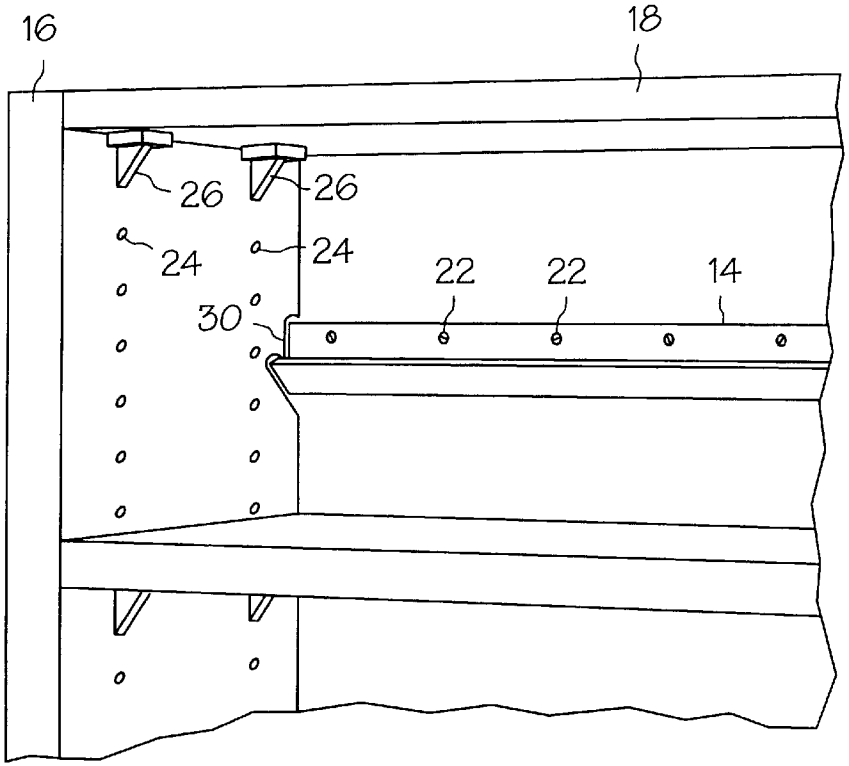
FIG. 2 presents a detailed perspective view of a portion of the shelving system of this invention.

As can be seen in FIG. 2, the horizontal support rail 14 includes a series of apertures 22 which are provided so that rail 14 can be positioned on the wall 12 by means of common fasteners, such as nails, screws and bolts. Desirably, the apertures 22 are spaced apart along the length of rail 14 so that at least one of the apertures 22 will align with a wall stud to provide the system 10 with secure attachment to the wall 12. To accomplish this, the apertures 22 are spaced from about 1 inch (2.54 cm) to about 1.5 inches (3.81 cm) apart.

The vertical support members 16 also include a series of holes 24. Typically, two rows of the holes 24 extend the length of the vertical support members 16. The holes 24 are provided to accommodate shelf supports 26 and the support pegs (not shown) for the hanging rods 20. The shelves 18 are supported by at least two, and desirably, four shelf supports 26, which each include a peg (not shown) which engages one of the holes 24. The hanging rods 20 are supported on each end by a pair of vertically spaced pegs (not shown), which each engage one of the holes 24.

Figure 3:
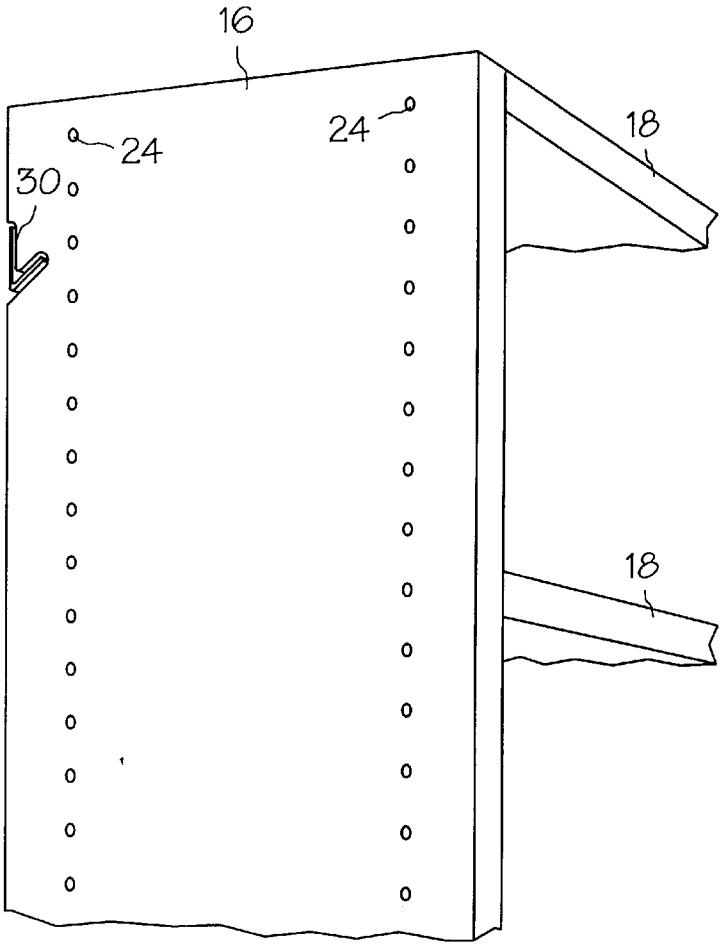
Fig. 3 presents another detailed perspective view of a portion of the shelving system of this invention.

As can be seen in FIGS. 2 and 3, each vertical support member 16 has a cutout portion 30 formed therein. Cutout portion 30 engages horizontal support rail 14 to support vertical support member 16 on rail 14. As can be seen in FIG. 3, cutout portion 30 has a shape which corresponds to the contour of support rail 14. Cutout portion 30 hangs on rail 14 and completely covers support rail 14. By completely covering support rail 14, vertical support member 16 can hang flush on wall 12 and, because it has a greater surface area making contact with wall 12, the distal end of vertical support member 16 from wall 12 is less subject to being moved when bumped or jarred.

Figure 4:
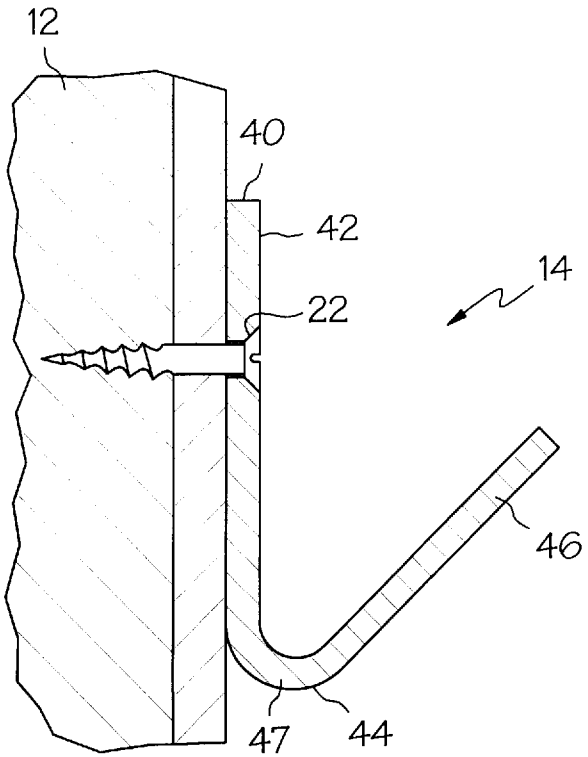
FIG. 4 presents a cross sectional view of the horizontal support rail of this invention.

FIG. 4 presents a cross sectional view of horizontal support rail 14. Rail 14 includes a shoulder 40; a mounting arm 42, in which apertures 22 are made; an elbow 44; a support arm or flanged portion 46, which is the primary support for vertical support member 16; and a bottom edge 47. Support rail 14 is mounted to wall 12 by means of the apertures 22 in mounting arm 42. Support arm 46 extends outwardly and upwardly from the bottom edge 48 of mounting arm 44. Elbow 44 has a thickness which is greater than the thickness of arm 42 or arm 46. For example, if arms 42 and 46 have a cross sectional width of 0.0058 inch, then elbow 44, at its thickest portion, will have a thickness of about 0.0116 inch. This increased cross sectional width of elbow 44 increases the load bearing capacity of elbow 44 and, subsequently, the load bearing strength of rail 14. Desirably, rail 14 is formed from a metal or metal alloy material. Most desirably, rail 14 is formed from 12 gauge steel.

Figure 5:
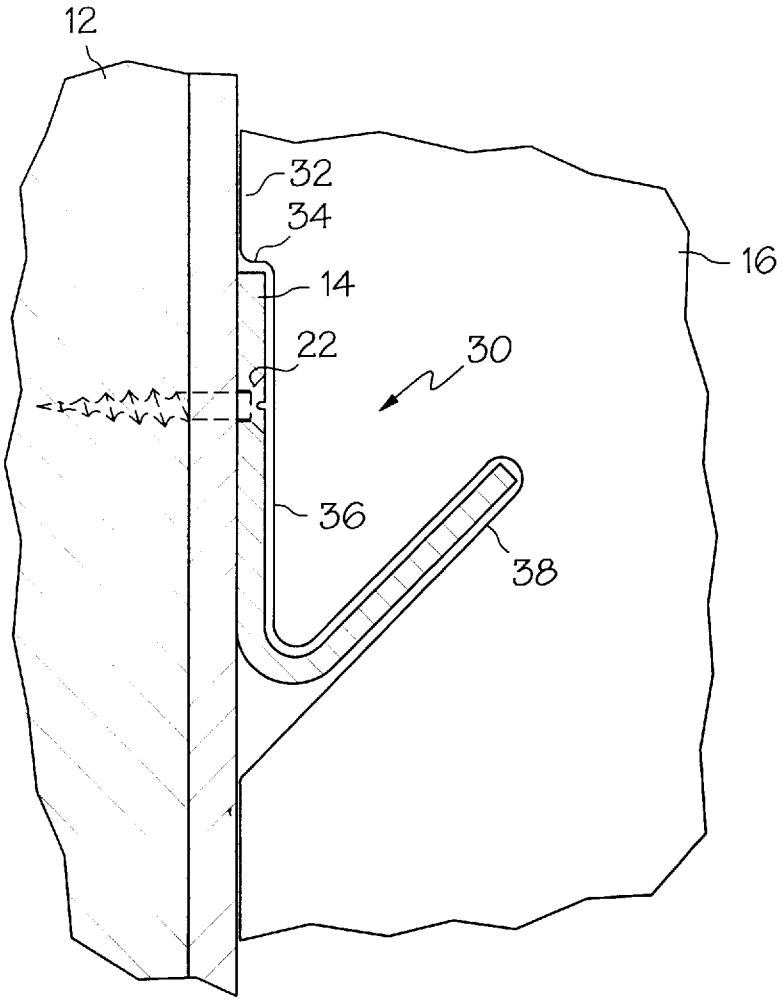
FIG. 5 presents a detailed cross sectional view of the vertical support member as supported on the horizontal support rail.

As can be seen in FIG. 5, cutout portion 30 is formed in one end portion 32 of vertical support member 14. Cutout portion 30 includes a support ledge 34, a flat portion 36 and a support arm engagement portion 38. Support ledge 34 extends generally horizontally in vertical support member 14 and flat portion 36 extends generally downwardly from one end of support ledge 34 in vertical support member 16. Support arm engagement portion 38 accommodates support arm 46 of horizontal support rail 14. Cutout portion 30 can be formed by routing, carving, chiseling or any other common woodworking or forming method. If vertical support member 16 is formed from metal or plastic, then cutout portion 30 may also be formed by molding.

A method for installing the shelving system 10 will now be discussed. First, the height at which the entire system 10 will be hung from the floor must determined. This height is primarily determined by the needs of the user. Once this height has been determined, a line is drawn on the wall 12 to serve as a reference for the height at which the horizontal support rail 14 is to be hung. Next, horizontal support rail 14 is secured to wall 12 by means of at least two fasteners. Desirably, the fasteners will be anchored in studs in the wall 12. If more than one horizontal support rail 14 is used, then each horizontal support rail 14 will be secured by two fasteners.

After the horizontal support rail 14 has been positioned on the wall 12, the vertical support members 16 are positioned on horizontal support rail 14. The number of support members 16 will depend upon the desired number and spacing of shelves 18 and/or hanging rods 20. Generally, more than two vertical support members 16 are hung on horizontal support rail 14. The vertical support members 16 are positioned on the horizontal support rail 14 in the following manner.

First, the cutout portion 30 in end portion 32 of vertical support member 16 is aligned with the support rail 14.

Next, the support member 16 is slid horizontally onto rail 14 so that support ledge 34 engages shoulder 40 and support arm engagement portion 38 engages support arm 46. The vertical support member 16 is then moved, by sliding, to the desired position on rail 14.

Figure 6:
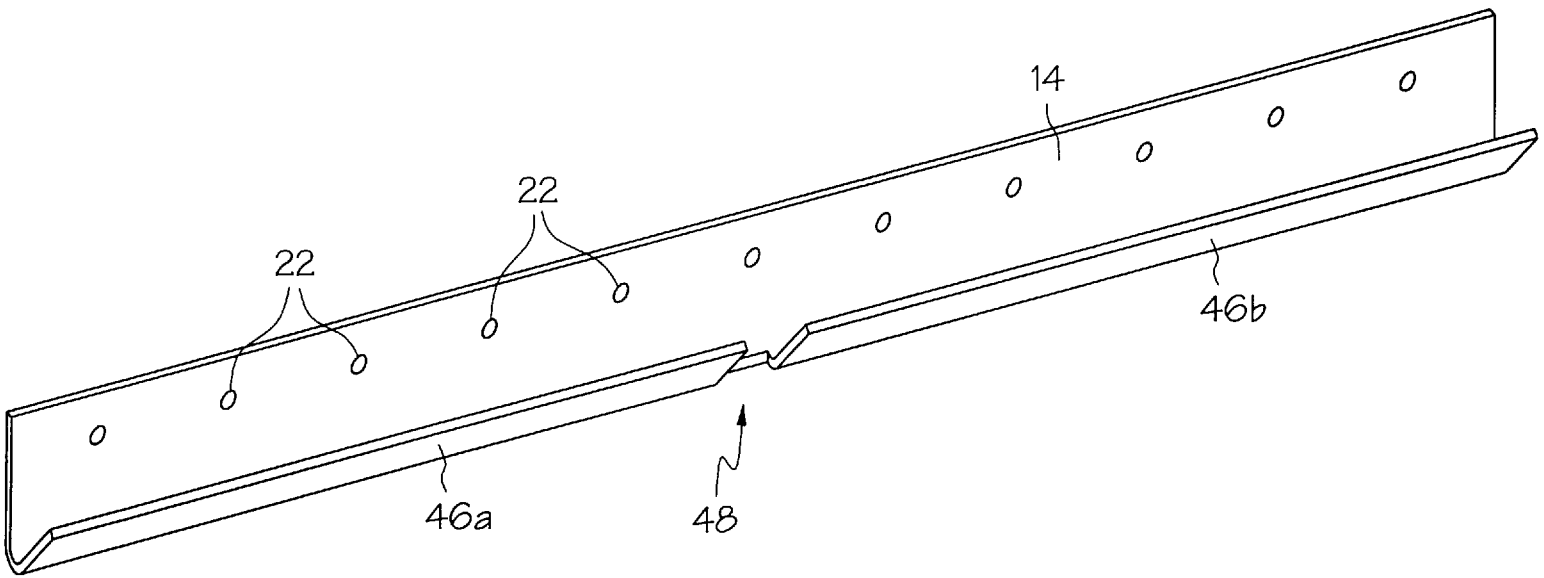
FIG. 6 presents a perspective view of an alternate horizontal support rail useful with this invention.

Desirably, the vertical support member 16 is slid horizontally onto horizontal support rail 14 by inserting vertical support member 16 into a space 48 in horizontal support rail 14 and sliding the vertical support member 16 to an end of horizontal support rail 14 which may be flush with a side wall. This is shown in FIG. 6. Horizontal support rail 14 may include one or more spaces 48 positioned at some point along its length. Basically, space 48 is a portion of horizontal support rail 14 at which support arm 46 has been removed or has not been formed. Space 48 separates support arm 46 into two support arm or flanged portions 46*a* and 46*b*. Space 48 will typically have a width which is slightly larger than the width of vertical support member 16. Space 48 is provided so that vertical support members 16 can be slid onto horizontal support rail 14 at a position other than the ends of horizontal support rail 14. Desirably, space 48 is positioned in the center of support rail 14 or, if two rails 14 are positioned end to end, the space 48 will comprise a portion of each rail 14 at the end of the rails 14 where the rails 14 meet. Alternatively, if vertical support member 16 is not going to be positioned flush with a side wall(s), the horizontal support rail 14 need not extend all the way to the side wall(s) and vertical support member 16 may be horizontally slid over the end(s) of horizontal support rail 14, rather than through space 48.

Because vertical support member 16 is positioned flush with wall 12 by means of cutout 30, the weight of the vertical support member 16 is primarily borne by elbow 44, which is the thickest portion of horizontal support rail 14, rather than support arm 46. Further support for vertical support member 16 is provided by the engagement of support ledge 34 with shoulder 40.

After the vertical support members 16 have been positioned, the shelves 18 and/or hanging rods 20 can be placed in position. To place the shelves 18, shelf supports 26 are positioned in the holes 24 in vertical support members 16. The shelves 18 are then placed on top of shelf supports 26. The hanging rods 20 are positioned by inserting their support pegs in holes 24. Care should be taken to ensure that vertical support members 16 are close enough together to provide sufficient support for the shelves 18 and the hanging rods 20.

To provide additional support for shelving system 10 and to prevent vertical support members 16 from moving when they are bumped or jarred, the shelving system 10 may also include L-shaped brackets 50. Brackets 50 are attached to a bottom end 52 of the vertical support member 16 after the vertical support member 16 has been positioned along horizontal rail 14. One portion of bracket 50 is fastened to wall 12 and the other portion of bracket 50 is secured in the bottom end 52 of vertical support member 16. By securing the bottom end 52 of vertical support member 16 to wall 12, vertical support member 16 is further prevented from undesired movement along horizontal support rail 14. Further, vertical support member 16 would also be prevented from "jumping" off support rail 14 if vertical support member 16 is bumped on its bottom end 52.

In another aspect of the invention, the shelving system 10 can be supported by two horizontal support rails 14. If shelving system 10 employs two rails 14, then each vertical support member 16 will have two cutout portions 30, as described above. Two support rails 14 can be used in situations in which the shelving system will be used to support heavy loads, for example, in a floor to ceiling bookcase arrangement.

When two rails 14 are used, the shelving system is installed as described above. In such a situation, each rail 14 must be positioned a vertical distance apart which corresponds to the distance between the cutouts 30 in vertical support members 16 so that the rails 14 and the cutouts 30 will align. Further, each rail 14 may include a space 48 to facilitate positioning of vertical support member 16.

While certain representative embodiments and details have been shown for purposes of illustrating the invention, it will be apparent to those skilled in the art that various changes in the shelving system disclosed herein may be made without departing from the scope of the invention, which is defined in the appended claims.

What is claimed is:

1. A wall mounted shelving system comprising:

a horizontal support rail mountable on a wall, the support rail having a bottom edge from which a flange extends upwardly and outwardly; and a plurality of vertical support members slidably mountable on the support rail, each vertical support member having an end portion which abuts the wall and a cutout portion in the end portion, the cutout portion being shaped to receive the flange of the support rail as the vertical support member is slid horizontally onto the support rail, the cutout portion further being shaped so that the end portion of the vertical support member will hang flush with the wall.

2. The shelving system of claim 1 further including at least one storage member removably mountable between two adjacent vertical support members.

3. The shelving system of claim 2 wherein the storage member is either a shelf, a hanging rod or both.

4. The shelving system of claim 1 wherein the flange extends about 45° outwardly from the horizontal support rail.

5. The shelving system of claim 1 further including a second horizontal support rail mountable on the wall, the second support rail including a second flange which extends upwardly and outwardly from the wall; and each vertical support member further including a second cutout portion in its end portion, the second cutout portion being shaped to receive the second flange of the second support rail as the vertical support member is slid horizontally onto the second support rail, the second cutout portion further being shaped so that the end portion of the vertical support member hangs flush with the wall.

6. The shelving system of claim 1 wherein the support rail further includes a plurality of openings spaced so that at least one of the openings can be positioned in a position corresponding to a stud in the wall.

7. The shelving system of claim 1 wherein the flange on the support rail further includes a space which separates the support rail into a first flanged portion and a second flanged portion, the space being provided to allow the vertical support members to be slidably positioned on the support rail from a position somewhere other than at the ends of the support rail.

8. The shelving system of claim 7 wherein the space has a width slightly greater than a width of the end portion of the vertical support member.

9. The shelving system of claim 1 further including an L-shaped bracket which is attached to the wall and a bottom portion of the vertical support member to prevent the vertical support member from being moved.

10. A method for installing a shelving system comprising:

mounting a horizontal support rail on a wall, the support rail having a bottom edge from which a flange extends upwardly and outwardly;

sliding horizontally onto the support rail a plurality of vertical support members, each vertical support member having an end portion which abuts the wall and a cutout portion in the end portion, the cutout portion being shaped to receive the flange of the support rail as the vertical support member is slid horizontally onto the support rail, the cutout portion further being shaped so that the end portion of the vertical support member hangs flush with the wall; and positioning storage members between the vertical support members.

11. The method of claim 10 further comprising the step of securing the vertical support members to the wall with a bracket.

12. The method of claim 10 wherein the support rail includes a space which separates the flanged portion into a first flanged portion and a second flanged portion and the step of sliding the vertical support member onto to the rail includes the step of sliding the vertical support member horizontally onto either the first flanged portion or the second flanged portion.

13. The method of claim 10 wherein the storage members are shelves and hanging rods.

* * * * *